US007575366B2

(12) United States Patent
Cretin

(10) Patent No.: US 7,575,366 B2
(45) Date of Patent: Aug. 18, 2009

(54) WATCH

(75) Inventor: Francis Cretin, Bois-d'Amont (FR)

(73) Assignee: Richemont International S.A., Villars-Sur-Glane (CH)

( * ) Notice: Subject to any disclaimer, the term of this patent is extended or adjusted under 35 U.S.C. 154(b) by 83 days.

(21) Appl. No.: 11/481,890

(22) Filed: Jul. 7, 2006

(65) Prior Publication Data

US 2007/0008824 A1 Jan. 11, 2007

(30) Foreign Application Priority Data

Jul. 8, 2005 (CH) ..... 1143/05

(51) Int. Cl.
*G04C 9/00* (2006.01)
*G04B 37/001* (2006.01)

(52) U.S. Cl. ..... 368/187; 368/88; 368/281; 368/309

(58) Field of Classification Search ..... 368/187, 368/276, 281, 284, 88, 309
See application file for complete search history.

(56) References Cited

U.S. PATENT DOCUMENTS

| | | | | |
|---|---|---|---|---|
| 2,679,135 A | | 5/1954 | Hanhart | |
| 3,759,033 A | | 9/1973 | Jeanmonod | |
| 4,244,044 A | * | 1/1981 | Olsson | 368/291 |
| 4,396,296 A | | 8/1983 | Stodden | |
| 4,451,159 A | * | 5/1984 | Tanaka | 368/69 |
| 4,956,827 A | | 9/1990 | Spadini | |
| 5,122,997 A | * | 6/1992 | Schneider et al. | 368/294 |
| 5,940,349 A | * | 8/1999 | Stewart | 368/69 |

FOREIGN PATENT DOCUMENTS

| | | |
|---|---|---|
| CH | 1 386 575 | 7/1977 |
| DE | 35 12 369 | 10/1986 |
| EP | 0 312 857 | 4/1989 |
| FR | 2 537 297 | 8/1984 |
| WO | WO 89/10585 | 11/1989 |
| WO | WO 95/25294 | 9/1995 |
| WO | WO 2004/012178 | 2/2004 |

* cited by examiner

*Primary Examiner*—Edwin A. Leon
*Assistant Examiner*—Thanh S Phan
(74) *Attorney, Agent, or Firm*—Young & Thompson

(57) ABSTRACT

The watch comprises a case (9) with a fixed part (10) in the shape of a bracket (20) and a mobile part (11) with a middle (21) and a movement (23) mounted onto the fixed part (10) so as to be able to swivel about a swivel axis (32) thanks to pivots (31) in order to realize a tilting motion of the mobile part (11) in two opposite directions. Two actuating mechanisms (44, 45) are mounted into the middle (21) and intended to transform the tilting motions into an action upon two control organs of functions of the movement that may be of the chronograph type. One thus obtains a watch without push-pieces, functioning precisely, having great stability and easy manipulation.

16 Claims, 6 Drawing Sheets

WATCH

FIELD OF THE INVENTION

The present invention relates to a watch comprising a case and a movement fitted with at least one control organ that is accessible from outside the movement and intended for activating at least one function.

DESCRIPTION OF THE RELATED ART

Watches of this type are known, and for instance offer the functions of start and stop and of zero reset of a chronograph watch. These watches generally have push-pieces protruding from the side of the watchcase, generally at the two o'clock position and at the four o'clock position.

These push-pieces make the watch generally bulkier and have the drawback of being elements that may get caught. They are not very comfortable to manipulate, above all for users wearing gloves. Their protruding shape may make the watch unpleasant to wear and produce a massive, not very aesthetic look. In addition, it is difficult to guarantee their protection against the entry of water and dirt, particularly when manipulating the push-pieces in a humid or polluting atmosphere.

SUMMARY OF THE INVENTION

It is the aim of the invention to remedy these drawbacks and create a watch without visible external push-pieces in which the functions integrated into the movement, such as the chronograph functions, may be activated very easily even while wearing gloves, and in which the function controls work in a well defined, highly precise manner while having a solid construction and long life. To that end, the watch according to the invention comprises a watch comprising a case having a fixed part and a mobile part. The mobile part is tiltably mounted onto the fixed part about a first pivot and a second pivot. The first and second pivots define a swivel axis of the mobile part and are located at two diametrically opposite positions with respect to the face of the watch (for example at 3 o'clock and 9 o'clock). The case houses a watch movement that comprises at least one control organ for mechanically activating a function of the watch. The watch further comprises an actuating mechanism coupled to the mobile part and operable to actuate the control organ in response to a tilting motion of the mobile part relative to the fixed part about said swivel axis.

In accordance with the invention external push-pieces are not used, and activation of the controls of functions of the movement is facilitated even when wearing gloves. The watch has a construction that is very solid and durable, and functions precisely owing to a tilting motion about a given swivel axis while conferring great wearing comfort und an aesthetic look.

Preferably, the movement comprises first and second control organs for activating a first function and a second function respectively. In this case the first control organ is actuated in response to a tilting motion of the mobile part relative to the fixed part in a first direction and the second control organ being actuated in response to a tilting motion of the mobile part relative to the fixed part in a second direction opposite to the first direction. As such, the watch may comprise a chronograph mechanism, with the first and second functions being respectively a start/stop function and a zero-reset function of said chronograph mechanism. These characteristics yield a very precise control of at least two function controls, particularly the functions of a chronograph watch.

Other advantages will become apparent from the characteristics expressed in the dependent claims and from the description setting forth hereinafter the invention in greater detail with the aid of drawings representing schematically and in exemplary fashion an embodiment.

DETAILED DESCRIPTION OF THE PREFERRED EMBODIMENTS

Figure 1:
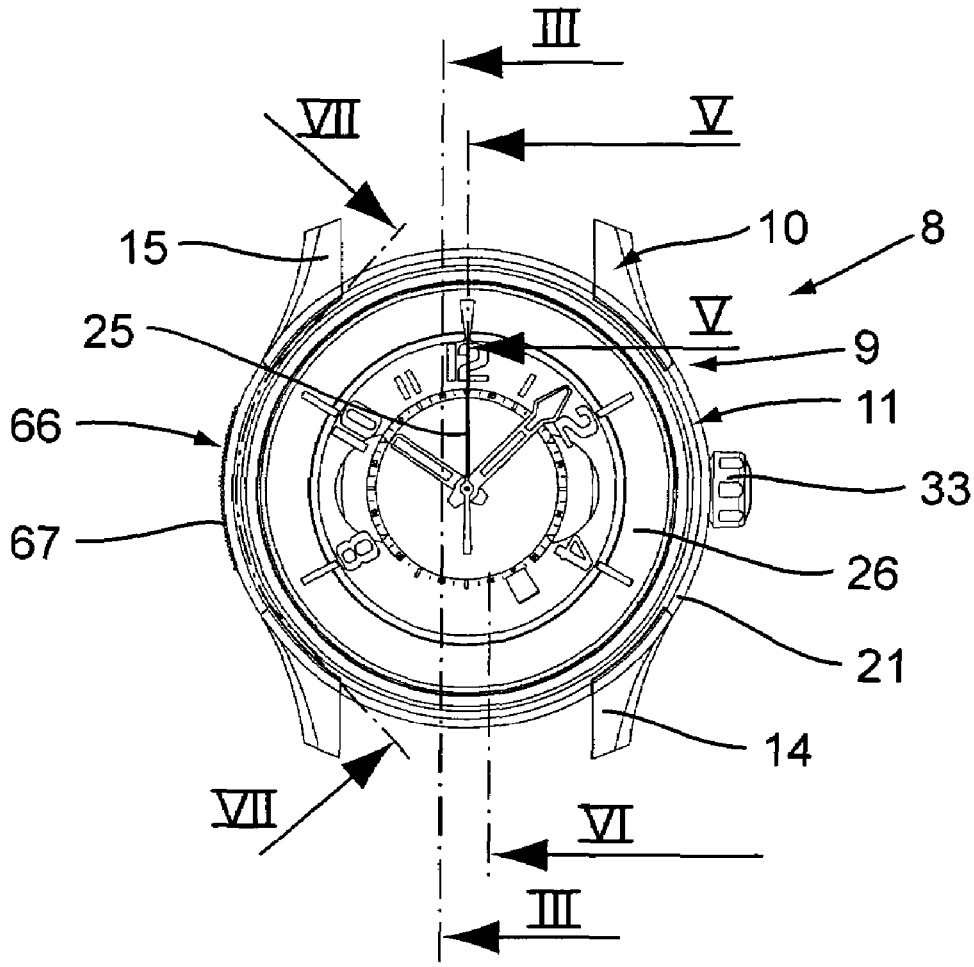
FIG. 1 is a plan view of this embodiment in the form of a chronograph without push-pieces.
Figure 2:
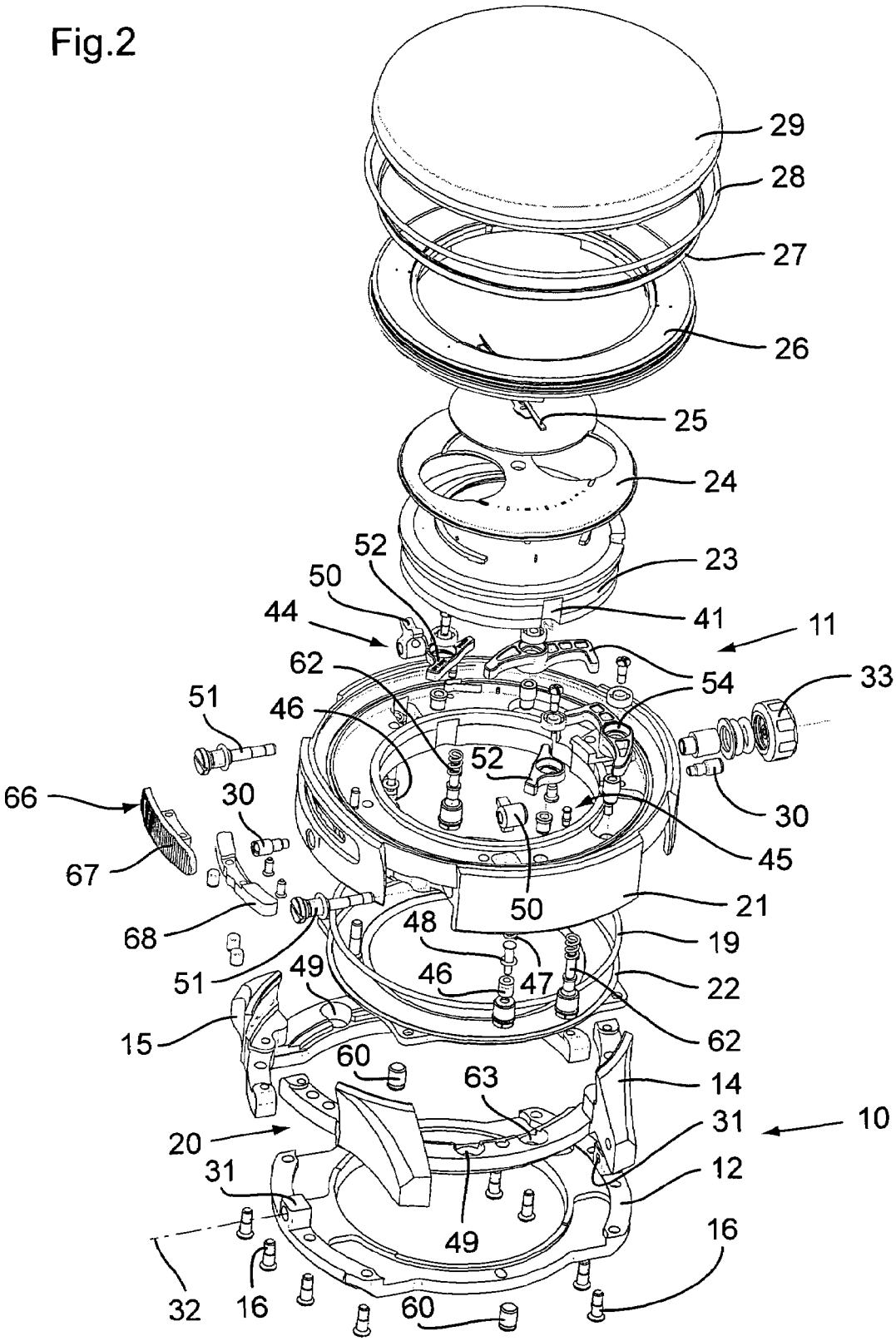
FIG. 2 is an exploded view of this chronograph.

The embodiment illustrated in the figures consists of a chronograph-type watch. This chronograph 8 comprises a watchcase 9 including a fixed part 10 and a mobile part 11 mounted so as to swivel about the fixed part 10. Referring to FIG. 2, said fixed part consists of a frame 12 and two horn segments 14, 15 attached to frame 12 by screws 16 so as to form a bracket 20 intended to hold the mobile part 11.

This mobile part 11 comprises a middle 21 sealed off below by a screwed bottom 22 with gasket 19.

The following elements are mounted into the middle, and can be seen in FIG. 2 from bottom to top: a movement 23, a dial 24, indicating organs 25, an inner bezel 26 screwed onto the middle, a collar 27 made of plastic, a sealing gasket 28 for the crystal, and a crystal 29, as well as a crown 33 of customary design.

The middle 21 is pivotably or tiltably mounted onto the bracket 20 through two screws 30 intended to cooperate with two pivot segments 31 provided on frame 12 in the 3 o'clock position and the 9 o'clock position. By pressing the upper side of the mobile part 11 at the 12 o'clock position or at the 6 o'clock position one obtains a tilting motion of the mobile part 11 relative to the fixed part 10 following a swivel axis 32 defined by the central axis of the two screws 30 and of the two pivot segments 31.

Figure 4A:
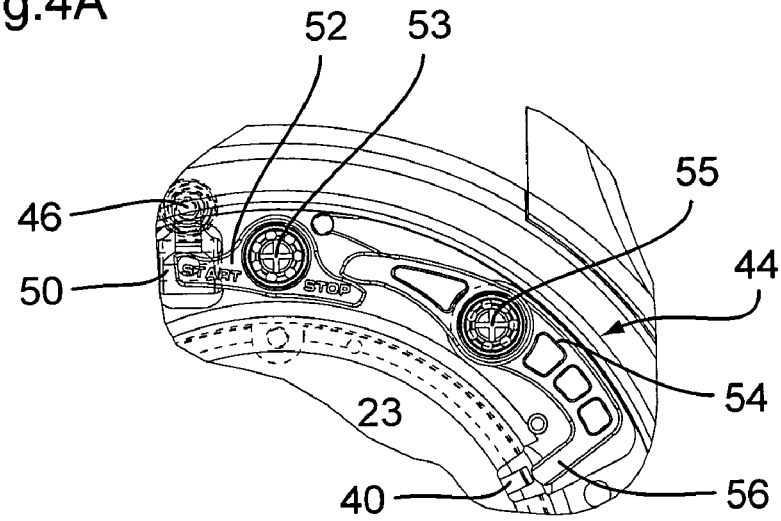
FIGS. 4A, 4B und 4C are plan views of details of the chronograph in the positions of rest 3A, start/stop control 3B, and zero reset 3C.
Figure 4B:
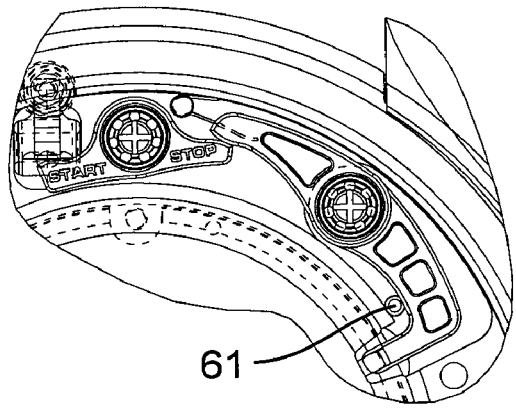
Figure 4C:
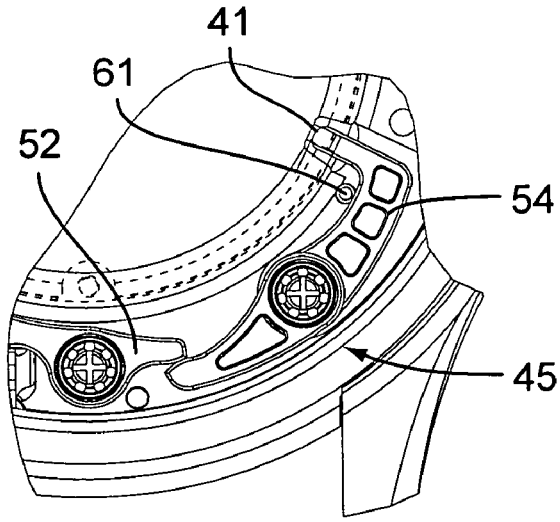

The movement 23 comprises two control organs 40,41 (FIG. 4) accessible from outside the movement, and intended to activate at least two functions, here the, functions of start/stop and of zero reset of the chronograph. As best seen in FIG. 4A, these control organs comprise stems extending outwardly from the movement that are arranged in conventional manner at the 2 o'clock position and at the 4 o'clock position.

For an activation of these two functions, the watch is provided with two identical actuating mechanisms 44, 45 cooperating with the fixed and mobile parts 10, 11 in order to transform the tilting motion of the mobile part 11 into an action upon either of the control organs 40, 41.

Figure 3A:
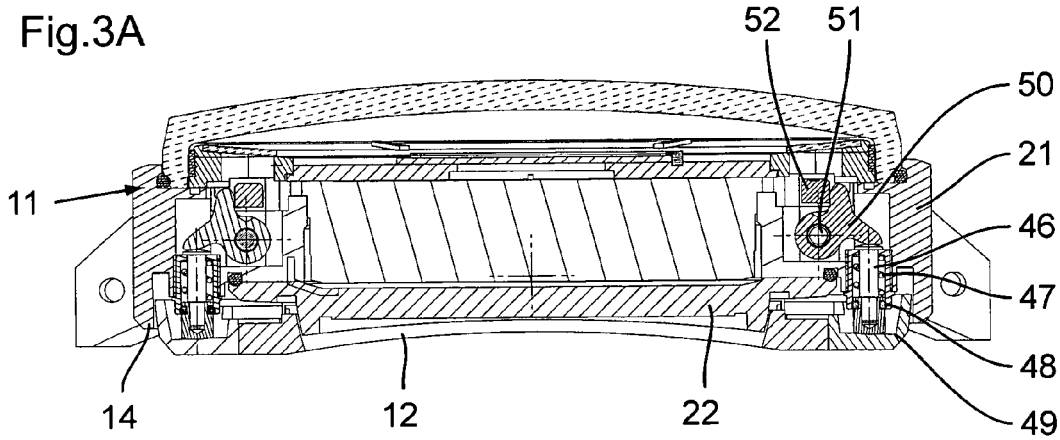
FIGS. 3A, 3B, 3C are sectional views along line III-III of FIG. 1 showing the chronograph in a rest position 3A, in a position of start/stop control 3B, and in a position of zero reset 3C.
Figure 3B:
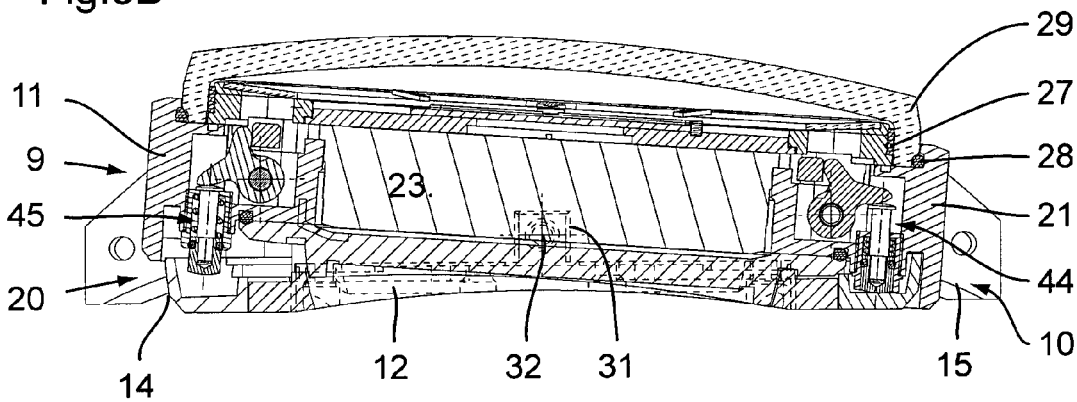

The two actuating mechanisms 44, 45 are mounted into the middle 21, each comprising a piston 46 (FIGS. 3A, 3B) mounted slidingly and sealingly into the middle 21 and provided with a spring 47 and a sealing gasket 48. The lower end of piston 46 cooperates with a recess 49 provided in the bracket 20, while the head of piston 46 is in contact with a first intermediate wheel 50 mounted rotatably about a screw 51 set horizontally into the middle 21.

This first intermediate wheel 50 acts upon a second intermediate wheel 52 mounted via a ball bearing on a vertical arbor 53 of the middle (FIG. 4A). The second intermediate wheel 52 drives a lever 54 mounted via a ball beating on a vertical arbor 55 of the middle. The curved end 56 of lever 54 is intended to activate control organ 40 or 41 of the movement 23. The two actuating mechanisms 44,45 have an identical design that is symmetric relative to a plane of symmetry passing through the 3 o'clock position and the 9 o'clock position, one 44 actuating the control 40 of start/stop, the other 45 actuating the control 41 of zero reset of the chronograph.

Figure 5:
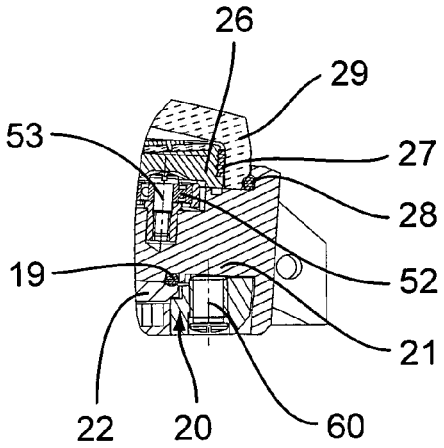
FIGS. 5 and 6 are sectional views along lines V-V and VI-VI of FIG. 1 showing details.

The tilting motion of the mobile part 11 in the two opposite directions is limited by two adjustable stops 60 screwed into the bracket 20 at the 6 o'clock position and at the 12 o'clock position (FIG. 5).

Figure 6:
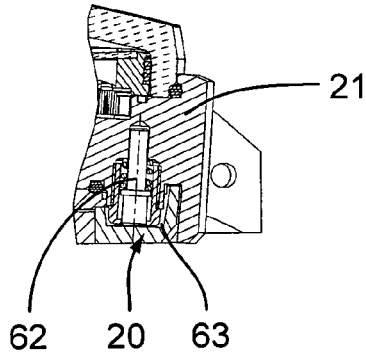

The middle 21 is provided with two poising buttons 62 (FIGS. 2 and 6) mounted next to the two pistons 46, and intended to cooperate elastically with recesses 63 provided in bracket 20, in order to stabilise and poise the mobile part 11 in its tilting motion.

The watch moreover comprises a selection mechanism 66 (FIGS. 2 and 7) mounted onto the middle 21 and including a cursor 67 intended to be actuated by the user, and a slide 68 screwed onto the cursor.

The bottom face of slide 68 has a recess 69, and is intended to cooperate with three pins 70, 71, 72 driven into bores of bracket 20 in order to realise a selection of the movements of mobile part (II).

Figure 7:
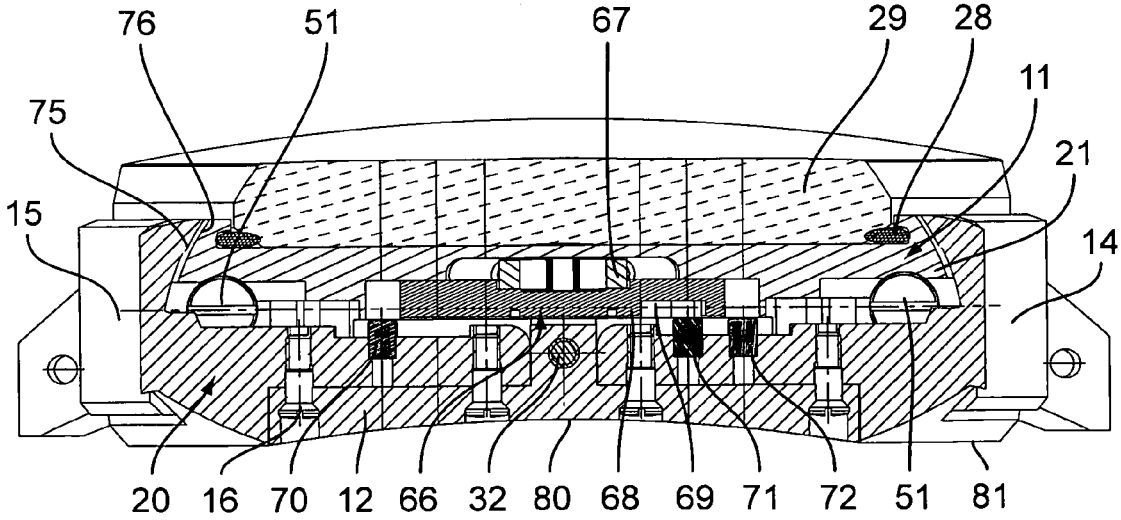
FIG. 7 is a sectional view along the line VII-VII of FIG. 1 and represents the selection means.

In the middle position illustrated in FIG. 7 none of the pins is in contact with slide 68, hence the mobile part 11 may be swiveled in the two directions in order to control the two chronograph functions of start/stop and zero reset.

With the cursor 67 pushed to the right in FIG. 7, pin 72 on the right is in contact with slide 68, hence the mobile part 11 may only perform a tilting motion counterclockwise about the swivel axis 32. A motion clockwise is inhibited. In this position a control of the start/stop function is possible while control of the zero-reset function is inhibited.

With the curser 67 placed to the left in FIG. 7, pins 70 and 71 are in contact with slide 68, and the mobile part 11 cannot be tilted, hence no control function of the chronograph can be effected.

FIG. 7 in addition shows the entire set of parts of the bracket 20 including the two horn segments 14, 15 screwed into the frame 12 with screws 16. The facing sides 75, 76 of the bracket 20 and mobile part 11 are machined so as to form cylindrical surfaces with a spherical base and very narrow gap allowing a sliding motion of one relative to the other during the tilting motion about the swivel axis 32, the latter constituting the central axis of the cylindrical surfaces.

Figure 8C:
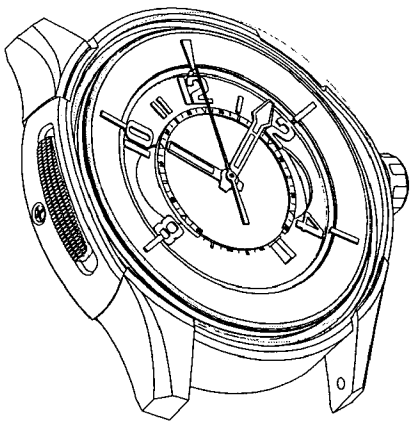
FIGS. 8A, 8B and 8C are views of this embodiment in the positions of rest 8A, start/stop control 8B, and zero reset 8C.
Figure 8B:
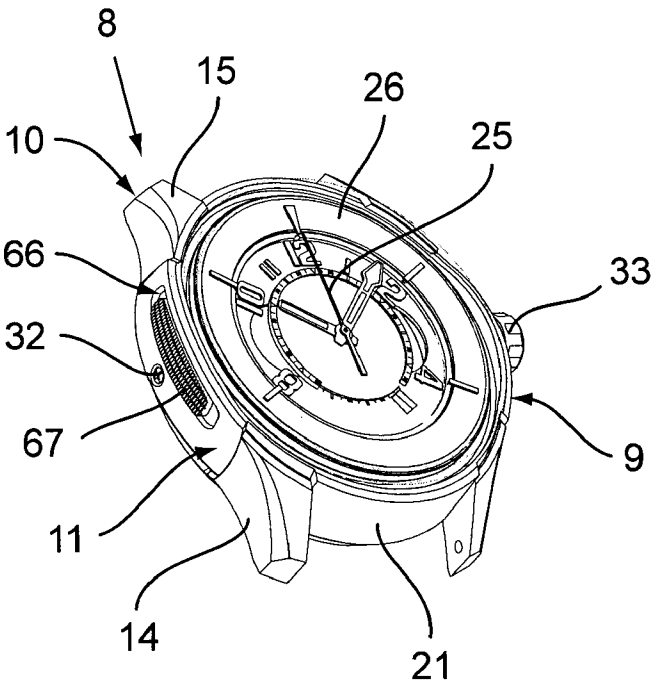
Figure 8A:
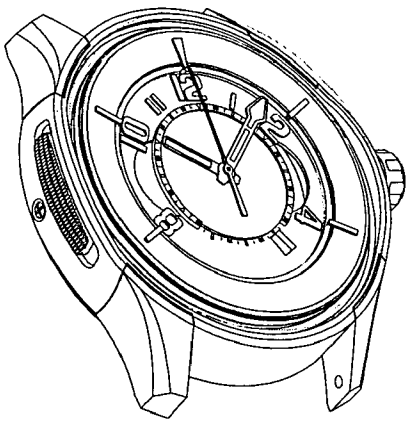

Referring to FIGS. 8A, 8B and 8C, this tilting motion is barely visible owing to the very narrow gap between the fixed and mobile parts 10, 11.

The control positions of the start/stop function (FIG. 8B) by pressing at the 12 o'clock position and of the zero-reset function (FIG. 8C) by pressing at the 6 o'clock position are barely distinguishable from the intermediate rest position of the mobile part 11 (FIG. 8A). Through this mechanism of tilting about a well-defined swivel axis 32, one obtains a precise working and a very easy control of the functions even when wearing gloves, while awkward and bulky push-pieces are avoided.

Figure 3C:
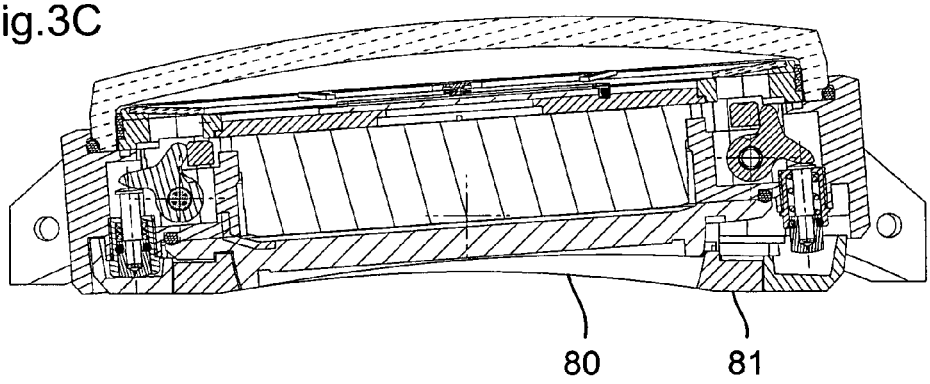

FIGS. 3C and 7 show that the bottom face of the bracket that is facing the wrist of the user exhibits a concave central segment 80 securing elevated wearing comfort. This central segment is surrounded by a peripheral flat segment 81 yielding a stable position of the watch when placed onto a flat support.

It is understood that the embodiment described hereinabove is not of a restricting character, and may receive any modification desired within the scope defined by the claims. In particular, the control functions of the movement may be of any other type, such as those of a repeater, a watch with striking work, a split timer, a timer, a watch with two or more time zones etc. The bracket and the mobile part may be of any other design.

The watch could also exhibit a double bracket with crossed swivel axes enabling a tilting motion about two perpendicular swivel axes. The actuating mechanisms and the selection means could have any other design.

The invention claimed is:

1. A watch, comprising:

a watch case having a fixed part and a mobile part, the mobile part being tiltably mounted onto the fixed part about a first pivot and a second pivot, the first pivot and the second pivot i) defining a swivel axis of the mobile part and ii) being located at two diametrically opposite positions with respect to a face of the watch, the watch case housing a watch movement comprising at least one control organ for mechanically activating a function of the watch; and an actuating mechanism coupled to the mobile part and being operable to actuate the control organ in response to a tilting motion of the mobile part relative to the fixed part about said swivel axis.

2. The watch according to claim 1, wherein the watch movement comprises a first control organ and a second control organ for activating a first function and a second function, respectively, the first control organ being actuated in response to a tilting motion of the mobile part relative to the fixed part in a first direction, and the second control organ being actuated in response to a tilting motion of the mobile part relative to the fixed part in a second direction opposite to the first direction.

3. The watch according to claim 2, wherein the watch further comprises a chronograph mechanism, and the first and second functions are respectively a start/stop function and a zero-reset function of said chronograph mechanism.

4. The watch according to claim 3, further comprising:

a selection mechanism mounted onto the mobile part for selectively inhibiting or enabling the tilting motion of the mobile part, the selection mechanism being positionable in at least two positions including a first position in which the mobile part is tiltable in both the first direction and the second direction, and a second position in which the mobile part is not tiltable in any of the first direction and the second direction.

5. The watch according to claim 4, wherein the selection mechanism comprises a slide and is further positionable in a third position in which the mobile part is tiltable in only the first direction.

6. The watch according to claim 2, wherein the fixed part includes a bracket comprising two horn pieces and a frame, the two pivots being provided on said frame.

7. The watch according to claim 6, wherein the watch movement is housed within the mobile part of the watch case, the mobile part comprising a middle, a bottom, a bezel, and a crystal enclosing said watch movement.

8. The watch according to claim 7, wherein the actuating mechanism is mounted on the middle of the mobile part and comprises, for each control organ, a first element cooperating with the bracket and linked to a second element cooperating with said control organ.

9. The watch according to claim 8, wherein the first element comprises a piston slidingly mounted on the middle of the mobile part and the second element comprises a lever, a first end of the piston cooperating with the bracket and a second end of the piston cooperating with a first intermediate wheel pivotable about a horizontal arbor of the middle, the first intermediate wheel cooperating with a second intermediate wheel pivotable about a first vertical arbor of the middle, and the second intermediate wheel cooperating with the lever, the lever being pivotable about a second vertical arbor of the middle.

10. The watch according to claim 9, wherein each of the first and second control organs comprises a stem, the stem extending outwardly from the watch movement and being operable to be axially driven by the lever.

11. The watch according to claim 10, wherein the stem of the first control organ extends axially from the watch movement at a two o'clock position with respect to the watch face, and the stem of the second control organ extends axially from the watch movement at a four o'clock position with respect to the watch face.

12. The watch according to claim 7, wherein the middle of the mobile part comprises buttons cooperating elastically with corresponding recesses in the bracket in order to stabilise and poise the tilting motion of the mobile part in each of the first direction and the second direction.

13. The watch according to claim 1, wherein the first pivot and the second pivot are located at a three o'clock position and a nine o'clock position with respect to the watch face.

14. The watch according to claim 1, wherein the fixed part includes a bracket comprising two horn pieces and a frame, the first pivot and the second pivot being provided in said frame.

15. The watch according to claim 14, wherein the watch movement is housed within the mobile part of the watch case, the mobile part comprising a middle, a bottom, a bezel, and a crystal enclosing said movement.

16. The watch according to claim 1, wherein the at least one control organ comprises a stem extending outwardly from the watch movement and being operable to be axially driven by a lever in the actuating mechanism.

* * * * *